US007611417B2

(12) United States Patent
Murrey et al.

(10) Patent No.: US 7,611,417 B2
(45) Date of Patent: Nov. 3, 2009

(54) GAME TABLE WITH LIGHTS

(75) Inventors: Patrick W. Murrey, Los Angeles, CA (US); Scott Thomas, Newburgh, IN (US); Mike Guerzini, Newburgh, IN (US); Jerry Schreiber, Evansville, IN (US); James R. Allshouse, Newburgh, IN (US)

(73) Assignee: SOP Services, Inc., Las Vegsas, NV (US)

( * ) Notice: Subject to any disclaimer, the term of this patent is extended or adjusted under 35 U.S.C. 154(b) by 930 days.

(21) Appl. No.: 10/453,358

(22) Filed: Jun. 3, 2003

(65) Prior Publication Data

US 2004/0067796 A1 Apr. 8, 2004

Related U.S. Application Data

(60) Provisional application No. 60/385,375, filed on Jun. 3, 2002.

(51) Int. Cl.
*A63D 15/00* (2006.01)

(52) U.S. Cl. ..... 473/4; 473/1; 106/22; 106/23

(58) Field of Classification Search ..... 473/1, 473/4, 6, 8, 29, 31; 273/309, 108.1, 108.2, 273/274, 108; 362/223, 632, 145, 146, 127, 362/477; 108/22, 23, 65
See application file for complete search history.

(56) References Cited

U.S. PATENT DOCUMENTS 1,163,412 A * 12/1915 Jorstad ..... 473/28
1,933,917 A * 11/1933 Matteson ..... 473/34
2,013,286 A * 9/1935 Naramore ..... 108/22
2,090,248 A * 8/1937 Chakow ..... 108/23
2,491,841 A * 12/1949 Walter ..... 340/523
2,632,843 A * 3/1953 Montague ..... 362/232
3,065,336 A * 11/1962 Stevens ..... 362/297
4,552,362 A * 11/1985 Oake ..... 273/237
4,612,606 A * 9/1986 Roberts ..... 362/146
5,470,765 A 11/1995 Stiefvater
5,653,640 A 8/1997 Shirley, Jr.
5,791,758 A 8/1998 Horgan et al.
5,918,932 A * 7/1999 Morrison et al. ..... 297/217.6

(Continued)

FOREIGN PATENT DOCUMENTS

DE 3918203 A1 * 12/1990

(Continued)

*Primary Examiner*—Mitra Aryanpour
(74) *Attorney, Agent, or Firm*—Woodard, Emhardt, Moriarty, McNett & Henry LLP

(57) ABSTRACT

Preferred embodiments of the present invention provide a game table, such as a billiards table, with lights. Preferred embodiments and features provide for lights mounted around the periphery of a game table or mounted on the sides of a game table. The lights may be internally or externally powered from the table. Certain preferred embodiments provide one or more power sources mounted to the game table to power the lights. Other preferred embodiments provide one or more solar panels to recharge the power source(s) mounted to the game table. In some preferred embodiments, the game table includes indirect lighting, such as downward or outward facing lights mounted on the sides or apron of a billiards table. In an alternate preferred embodiment, rope lights are mounted around the periphery of a table.

19 Claims, 8 Drawing Sheets

U.S. PATENT DOCUMENTS

| | | | | |
|---|---|---|---|---|
| 5,941,778 | A | 8/1999 | Vasalech | |
| 6,116,748 | A * | 9/2000 | George | 362/145 |
| 6,231,217 | B1 * | 5/2001 | Krippelz, Sr. | 362/477 |
| 6,279,905 | B1 * | 8/2001 | Malavazos et al. | 273/126 A |
| 6,554,281 | B2 * | 4/2003 | Flannery | 273/274 |
| 6,561,897 | B1 * | 5/2003 | Bourbour et al. | 463/13 |
| 6,854,728 | B2 * | 2/2005 | Oister et al. | 273/108.1 |
| D512,466 | S * | 12/2005 | White et al. | D21/397 |
| 2002/0127283 | A1 * | 9/2002 | Sterner et al. | 424/630 |
| 2004/0070149 | A1 * | 4/2004 | Lipscomb et al. | 273/309 |
| 2004/0127283 | A1 * | 7/2004 | Martin et al. | 463/29 |
| 2004/0164488 | A1 * | 8/2004 | Fitzgerald | 273/108.1 |

FOREIGN PATENT DOCUMENTS

| | | | |
|---|---|---|---|
| GB | 2232606 | A * | 12/1990 |
| WO | WO 9847586 | A1 * | 10/1998 |

* cited by examiner

GAME TABLE WITH LIGHTS

This application claims priority to and incorporates by reference U.S. Provisional Application Serial No. 60/385,375 filed Jun. 3, 2002.

FIELD OF THE INVENTION

This invention relates to a game table. In particular, the invention relates to various game tables with lights.

BACKGROUND OF THE INVENTION

Traditional game tables, for example billiard or hockey tables, are placed in central locations to allow the players access to the table for playing a game on the table surface. Sufficient light is needed when a game table is used. Although some areas are well lighted, others can be in dimly lit locations which are indoors or outdoors making it difficult to view the playing surface clearly.

In other situations, certain tables can be difficult to locate in dimly lit areas, thus requiring external lighting to assist people to locate the table in order to play a game or to avoid a collision such as walking into the side of a table. An indirect and decorative method of illuminating a game table would facilitate people to find or avoid tables in dimly lit areas.

A need exists for a game table that includes lighting. Certain preferred features of the present invention address these and other needs and provide other important advantages.

SUMMARY OF THE INVENTION

Preferred embodiments of the present invention provide a game table, such as a billiards table, with lights. Preferred embodiments and features provide for lights mounted around the periphery of a game table or mounted on the sides of a game table. The lights may be internally or externally powered from the table. Certain preferred embodiments provide one or more power sources, for example batteries, mounted to the game table to power the lights. Other preferred embodiments provide one or more solar panels to recharge the power source(s) mounted to the game table.

In some preferred embodiments, the game table includes indirect lighting, such as downward or outward facing lights, mounted on the sides or apron of a billiards table. In an alternate preferred embodiment, rope lights are mounted around the periphery of a table.

It is a preferred object of certain preferred embodiments to provide a game table with lights.

It is one preferred object of certain embodiments of the present invention to provide a game table with indirect lighting.

Other objects and advantages of preferred embodiments of the present invention shall be apparent from the accompanying drawings and description.

Each embodiment described herein is not intended to address every object described herein, and each embodiment does not include each feature described.

BRIEF DESCRIPTION OF THE DRAWINGS

FIG. 3A top view of an alternate preferred embodiment.

BRIEF DESCRIPTION OF PREFERRED EMBODIMENTS

Figure 1A:
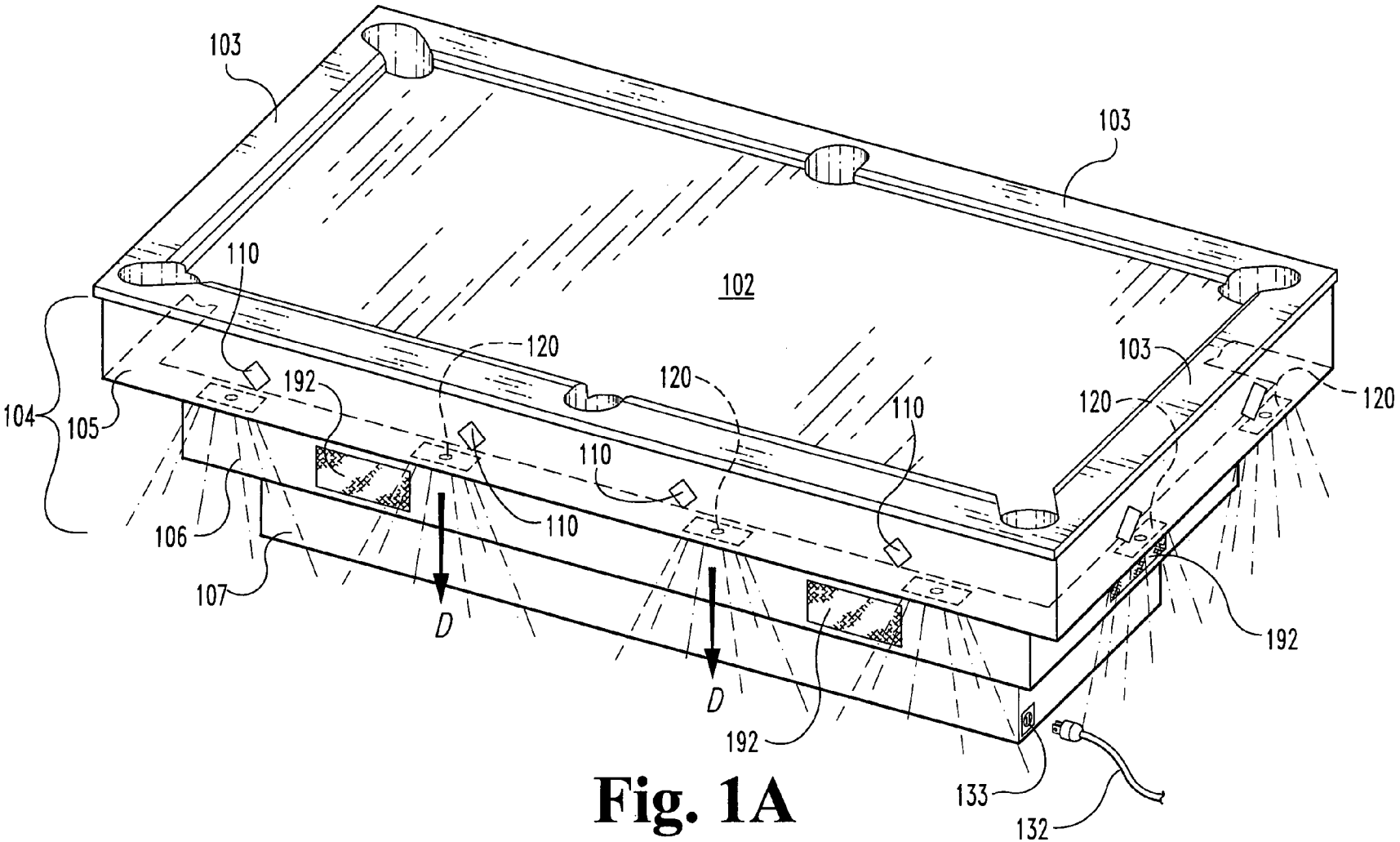
FIG. 1A is a perspective view of one preferred embodiment of the present invention.

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

In preferred embodiments, the present invention provides a game table with lighting. Typical types of game tables include those designed for billiards, pool, snooker, table soccer, foosball, table hockey, air hockey, card games, bumper pool, table tennis, or shuffleboard as well as conversion tables designed for playing two or more games. A standard table includes a playing surface, held over a support surface, such as a floor, by a support structure such as one or more legs or pedestals. The playing surface is often rectangular or round, but may be made in various geometric shapes.

In many instances, the playing surface is surrounded by a peripheral rail, which typically functions to retain game pieces within the area of the playing surface. Certain tables may also or alternately include an apron extending downwardly from the rail or playing surface. The apron may extend partially or completely to the floor or support surface.

In its broadest embodiments, the present invention includes a game table with one or more light sources mounted to it. Preferably the light sources are mounted around the periphery of the playing surface, and provide direct or indirect lighting. In certain embodiments, the light sources are mounted on the top, vertical sides or bottoms of the rails, or on or within a table apron. In certain preferred embodiments, the light sources provide indirect lighting, which means light primarily directed away from the playing surface, while in other embodiments, direct lighting of the playing surface may be provided.

The light sources may be various types of light producing systems, such as light emitting diodes or LEDs, fiber-optic strands from a light generator, incandescent light bulbs, fluorescent lights, rope lighting or neon lights. In certain embodiments, reflectors may be used with the light. Appropriate power sources are provided to power the corresponding type of light system with AC or DC current, such as dry or wet cell batteries, rechargeable batteries; solar cells, standard household current, generators or fluorescent or neon ballasts. Appropriate electric conversion methods such as transformers, when necessary, are well known and not described herein.

When a power source is specifically referred to as mounted to, on or within a game table, it is intended to mean a separate or independent power source, such as a battery pack, not connected to a power source external of the table during use. The embodiments and claims herein are not limited to power sources mounted to a game table unless specifically indicated.

Certain embodiments herein may rely on an external power source.

Various types of controls may be used with the lighting system, including direct switching, timers, light-sensitive switching, one or more pre-programmed logic cards, or remotely wired or wireless switching. Preferably the light sources, power sources, controls and wiring are mounted unobtrusively to the game table.

The basic structure and materials of an indoor or outdoor table are well known. For example, to be suitable for outdoor use, the game table should be constructed of materials that do not abnormally deteriorate when the materials are allowed to remain outside a climate controlled structure. Many game tables that are suitable for outdoor use are also suitable for indoor use.

Figure 1B:
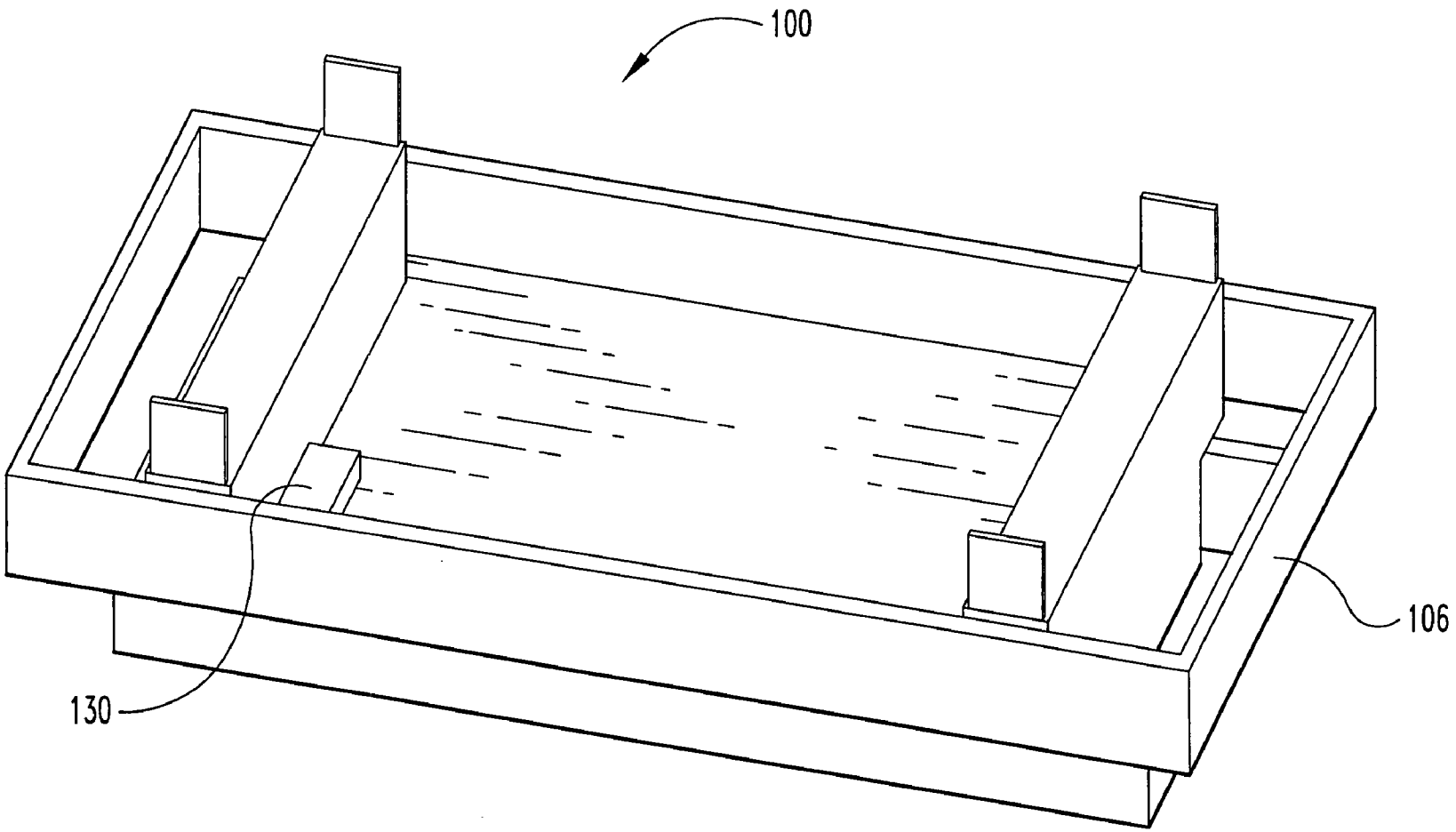
FIG. 1B is a perspective view of the base of the embodiment shown in FIG. 1A.
Figure 1C:
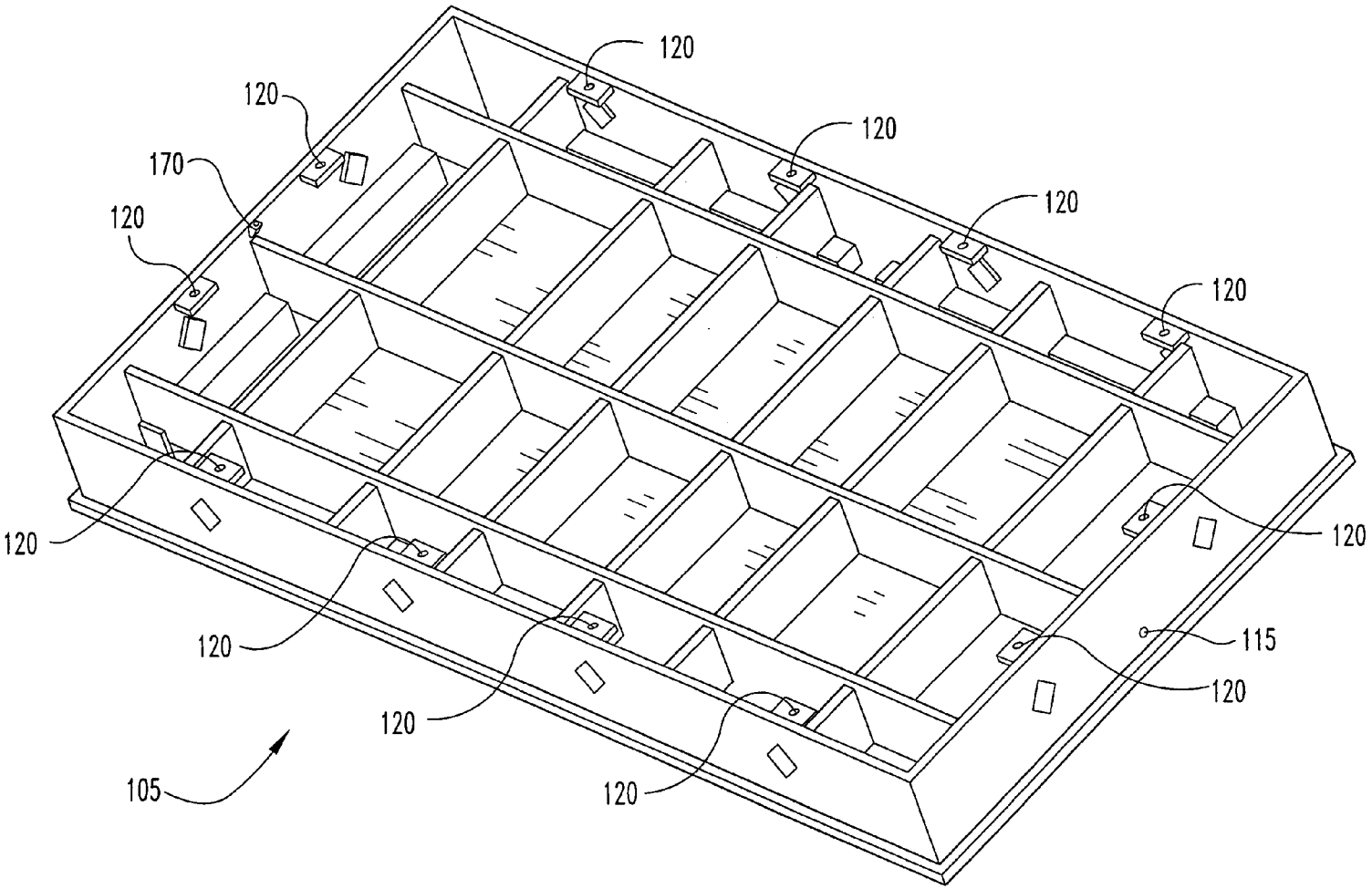
FIG. 1C is a bottom view of the upper tier of the embodiment shown in FIG. 1A.

A game table 100 according to one preferred embodiment of the present invention is illustrated in FIGS. 1A-C. Game table 100 is illustrated as a billiards table, including a playing surface 102 surrounded by a railing 103 and supported by the base of a stepped apron 104. The billiards table has a top surface, two vertical end portions and two longer vertical side portions. Apron 104 includes upper, middle and lower portions or tiers 105, 106 and 107. Shown in partial cut-away are lights 120, mounted on a lower portion of upper tier 105 above middle tier 106. Lights 120 are situated in the horizontal distance between the vertical outer portion of upper tier 105 and middle tier 106. Lights 120, for example LEDs, are oriented to reflect in downward direction D toward the support surface.

Preferably the lights are powered by one or more power sources. The power source(s) may be mounted internally to the table, such as a battery pack 130 including one or more electric cells. As an alternative, table 100 may be powered externally via a conventional power cord 132 connected to table 100 at a receptacle 133. As a further alternative, battery pack 130 may be rechargeable and is periodically recharged via external power cord 132, which may be disconnectable.

Certain embodiments may optionally include solar panels. In the embodiment shown, optional solar panels 110 are mounted in upper tier 105. Solar panels 110 may be mounted in the top or sides of railing 103 in a suitable orientation to absorb radiation, such as sunlight, and preferably are recessed to prevent undesired exposure or damage. In a preferred embodiment, each solar panel is protected by a solar-radiation transparent cover. Solar panels 110 function to receive solar energy and convert it to electricity to be stored in one or more internal power sources mounted to table 100.

Various control systems may be used with table 100. For example, a manual switch or circuit board 170 (FIG. 1C) may be mounted to the table to turn the light system on or off. In a contemplated option, switch 170 may control whether the lights are on or off independently of whether a battery pack is being charged and may include basic control logic. Alternately, a light sensor 115 may detect when the ambient light falls below a minimum and triggers the switch or controller to turn the lights on. Light sensor 115 and the control circuit may further operate to turn the lights off if the light level exceeds a threshold or after a pre-set period of time.

Optional features which table 100 may incorporate include one or more storage drawers, one or more stereo speakers 192 or an internally mounted audio system such as a radio.

In the preferred embodiment illustrated (FIG. 1A), the sides of game table 100 are configured in an upside-down tiered arrangement where the lower apron tiers 106 and 107 are offset horizontally inward from upper tier 105. Upper tier 105 has the largest circumference while middle tier 106 and lower tier 107 have consecutively smaller circumferences. In the embodiment shown, lights 120 are mounted on the lower side of upper tier 105 and are between the outer wall of upper tier 105 and middle tier 106. Lights 120 are mounted downward such that the light primarily impinges on middle tier 106 and the ground. In an alternate embodiment, the upper tier 105 is either partially or completely transparent or translucent to allow light to disperse though all or selected portions of the apron.

Figure 1D:
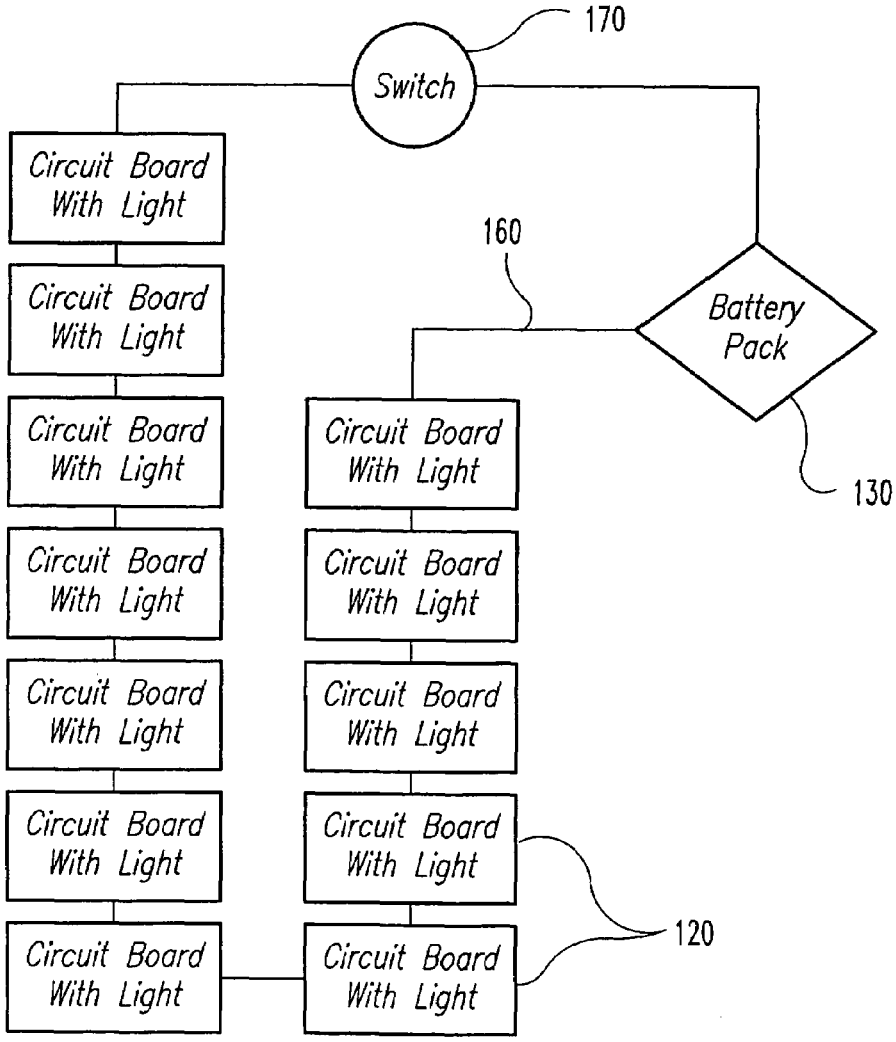
FIG. 1D is an example of a schematic that could be used in the embodiment shown in FIG. 1A.

FIG. 1D illustrates an example schematic which may be used with table 100. The circuit includes a central battery pack 130, controlled by switch 170, and multiple lights 120.

Figure 2B:
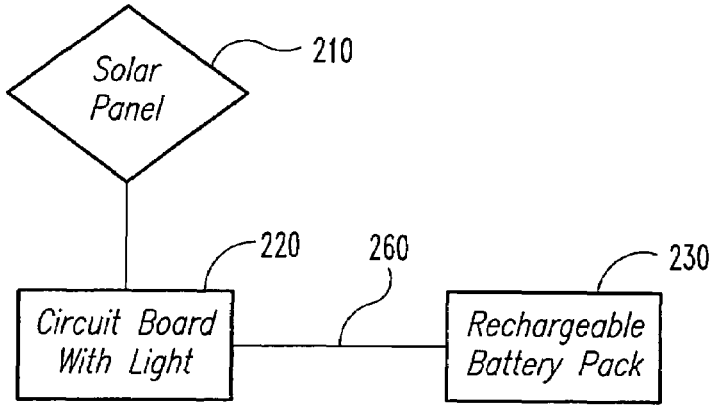
FIG. 2B is an example of a schematic which could be used in the embodiment shown in FIG. 2A.
Figure 2A:
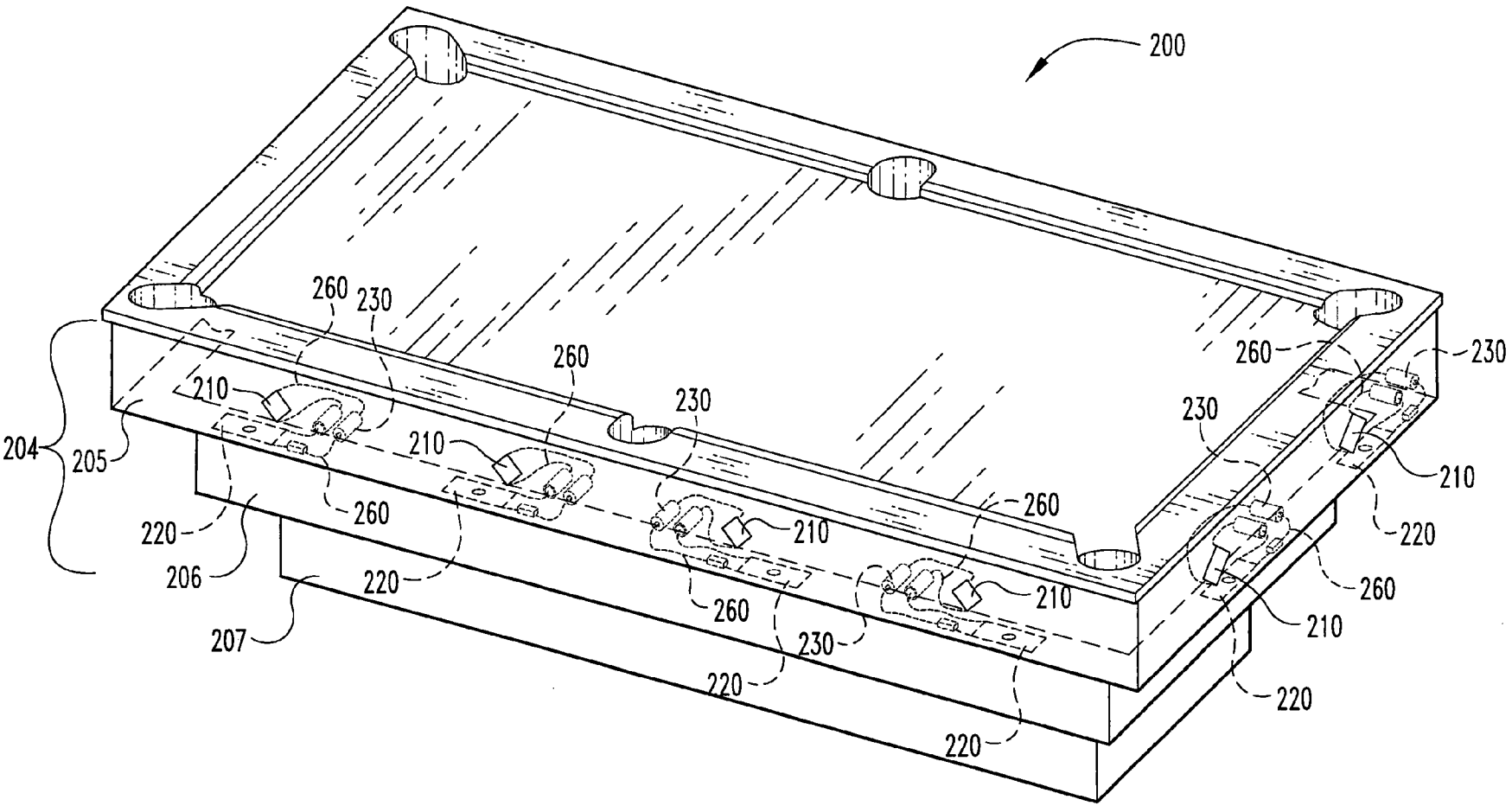
FIG. 2A is a perspective view of another preferred embodiment of the present invention.

FIG. 2A depicts an alternate embodiment—game table 200, similar to game table 100. Game table 200 includes apron 204. Apron 204 includes upper, middle and lower portions or tiers 205, 206 and 207. One or more lights 220 are mounted to the external periphery of table 200 along the sides. Lights 220 may extend from the railings or sides, but are preferably recessed in the upper apron tier 205. Lights 220 may direct light outward or downward.

Figure 4:
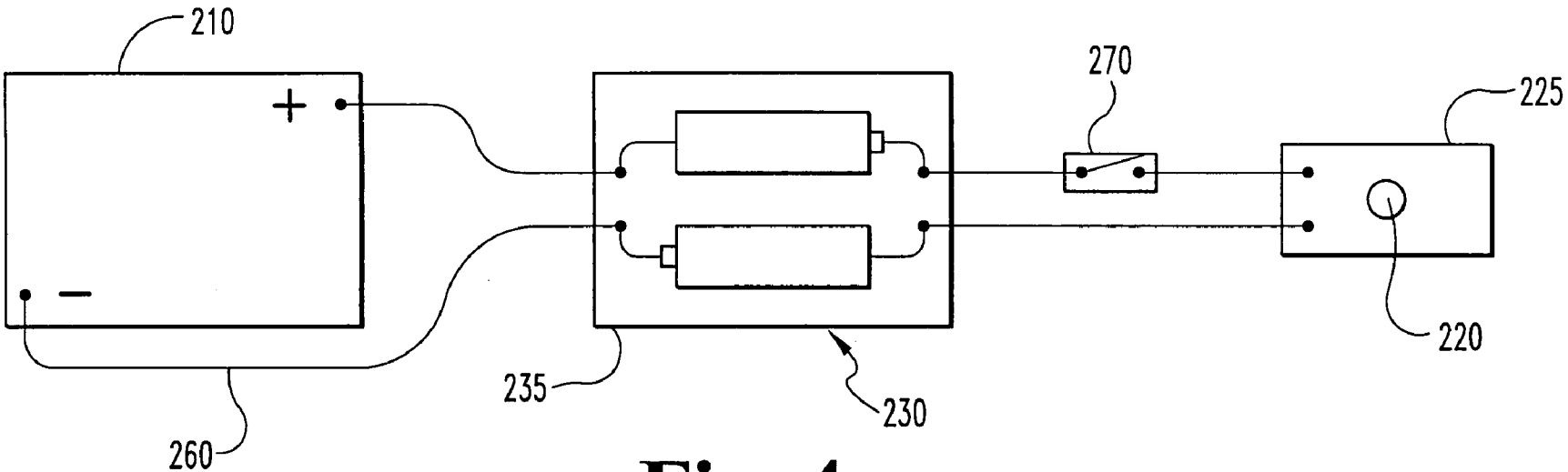
FIG. 4 is a schematic view of circuitry for one embodiment of the present invention.

As illustrated in FIG. 2A, with an example schematic in FIG. 2B, separate energy collection panels 210 are electrically connected via wires 260 to rechargeable battery packs 230, lights 220 and switches 270 in separate circuits. A schematic of an example circuit of this style is also shown in FIG. 4. The example circuit includes a lighting panel 225 for mounting light 220, and a battery panel 235 for mounting batteries. Each circuit may function independently to charge the batteries, plus power the light source and control the emission of light. Preferably, the batteries, switches and wires are hidden from view in the inside of a game table.

Figure 3A:
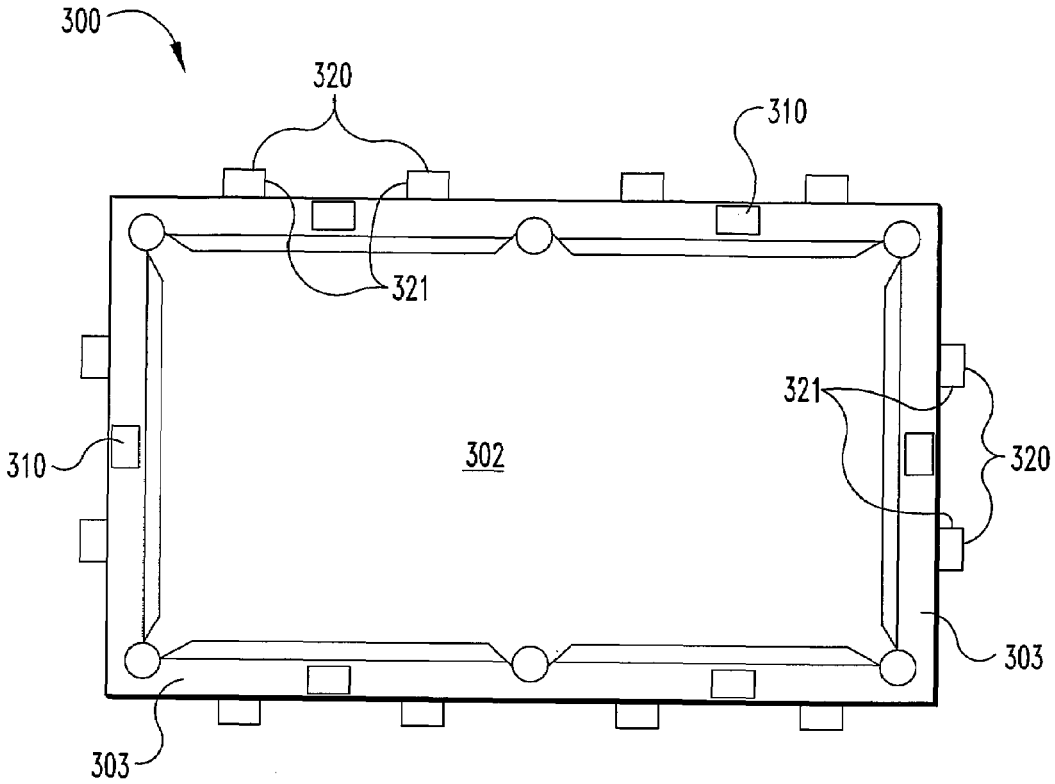
Figure 3B:
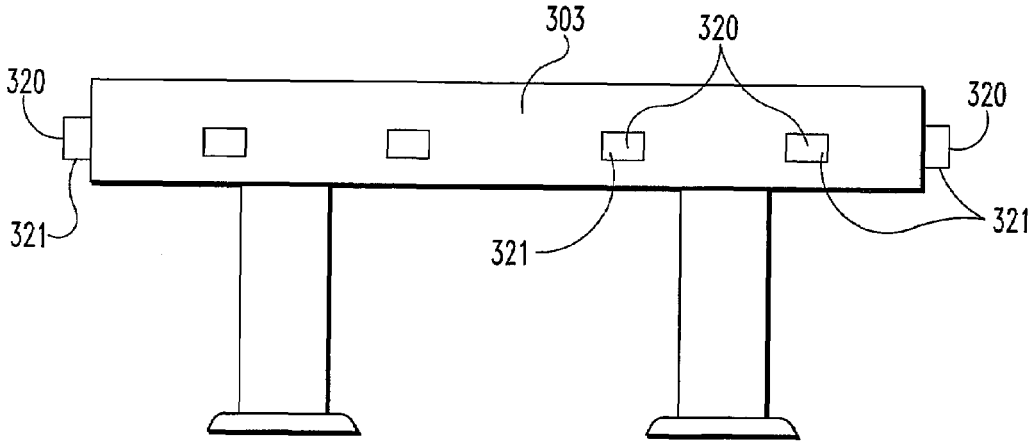
FIG. 3B is a side view of the embodiment shown in FIG. 3A.

Illustrated in FIGS. 3A-B is an alternate game table 300. Game table 300 is a standard table including playing surface 302, typically surrounded by a railing 303. In this embodiment, optional solar panels 310 are located in the top or upper surface of railing 303. Also illustrated are indirect lights 320 extending from the sides of railing 303. Lights 320 may be exposed, or may have protective covers, for example, protective covers 321. Light may be directed upward, outward, downward, or a combination thereof as desired. Table 300 may use the circuits shown in FIGS. 1D or 2B or other circuits.

In one preferred embodiment, the batteries, energy collection panels and lights are controlled automatically using a circuit board with control logic. The control may utilize a light sensor and/or current sensor to detect the amount of ambient light present. If the ambient light level exceeds a threshold value, energy collection panels recharge the battery pack(s) and turn the lights off. If the ambient light level is below a threshold value, the batteries provide power to the lights.

Other preferred embodiments incorporate a manual selection switch to override the automatic connection logic. In these embodiments, the switch can permit the closing of the charging circuit and allow charging of batteries irrespective of the amount of ambient light present or the current being supplied by energy collection panel(s). Conversely, the switch can also permit the closing of the discharging circuit and allow discharge of the batteries irrespective of the amount of ambient light present or the current being supplied by energy collection panels. In still other embodiments, the manual selection switch is wired or wireless to be remotely actuated.

Figure 5:
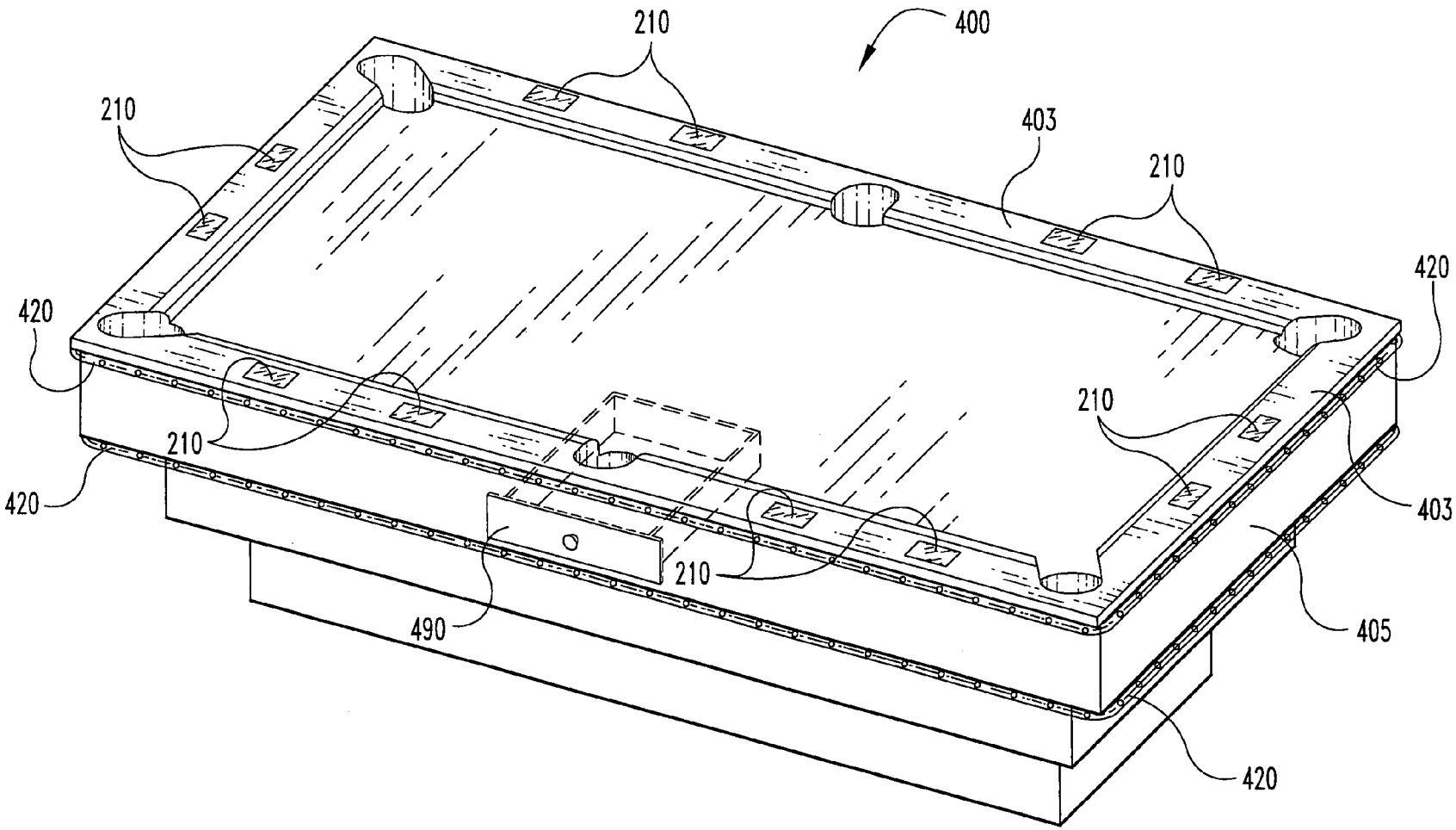
FIG. 5 is a perspective view of another preferred embodiment of the present invention.

FIG. 5 depicts another embodiment, game table 400, which is structurally similar to game table 100 with respect to the game playing structure. In game table 400, lights may be mounted on the tops, outsides or underneath the railings to provide indirect lighting. Various types of light sources can be used, such as rope light 420. Rope light 420 can be mounted to the outer edges of upper tier 405 or in a recessed channel and may be one rope light or a series of rope lights. Other embodiments utilize different configurations of rope lights, such as to completely outline game table 400 or to form letters or words.

As an optional feature, lights 420 may be configured to blink, flash, strobe, appear to move or to otherwise draw attention to the table. In more complex embodiments, the lights may be integrated with a control system to respond to game parameters, such as score being made or money being deposited in a mechanism.

Preferred embodiments use a game table that is suitable for outdoor use, while other preferred embodiments may use tables that are primarily suitable for indoor use. Example embodiment game tables include those suitable for playing billiards, table soccer, foosball, table hockey, air hockey, card games, bumper pool, table tennis, shuffleboard or multiple games. The dimensions and materials of the billiard and game tables may be adjusted as necessary to meet differing needs as is known in the art. Example structural materials are weather-treated lumber, plastic, or composite construction material such as CPI Plastics Group's Eon™. Examples of other materials are Sunbrella® or other weather resistant outdoor fabric for the playing surface, various weather resistant plastics for the pockets and various weather resistant foam-type plastic products for the bumpers.

Various types of energy storage cells such as rechargeable or non-rechargeable batteries may be used. Example rechargeable batteries include dry cell nickel cadmium, nickel metal hydride, lithium ion, or ceramic electrolyte as well as various wet cell batteries such as lead acid. Various sizes and numbers of interchangeable batteries may be implemented, some examples being sizes D, C, AA, AAA, 9 volt or 12 volt.

Various types of lights may be used, some examples being light emitting diodes, as well as fluorescent, incandescent, and fiber optically transmitted lights. Other example embodiments include side-mounted lights that are not recessed, bottom-mounted lights, lights that are held in extended positions from the table, lights recessed below a transparent surface of the game table and lights that hang or dangle from the table.

In one optional feature, some preferred embodiments employ a removable protective cover for the game table. Some protective covers have portions to allow light to impinge the energy collection panels while protecting the table surface. Other optional features include powered components such as built-in coolers or refrigerators, a stereo or stereo speakers 192, or unpowered components such as a drawer 490.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for providing lighting on a game table comprising:

providing a game table for placement on a support surface, the game table including a playing surface, and a peripheral rail surrounding said playing surface, the peripheral rail defining a playing surface side and at least one of a top side, an outside vertical side and a bottom side, wherein said playing surface side borders said playing surface, and wherein said bottom side of the peripheral rail defines an inwardly extending offset distance from said outside vertical side;

attaching one or more power sources mounted to said game table;

mounting one or more lights along the inwardly extending offset distance from said peripheral rail outside vertical side;

orienting the one or more lights to face downward toward the support surface; and powering said one or more lights with said one or more power sources.

2. The method of claim 1 further comprising orienting said one or more lights to provide indirect lighting.

3. The method of claim 1 wherein said attaching one or more power sources includes attaching one or more batteries.

4. The method of claim 3 wherein said attaching includes attaching a plurality of independent circuits wherein each circuit includes at least one power source and at least one light.

5. The method of claim 4 wherein said attaching includes attaching a solar panel operable to charge said at least one power source to each said plurality of independent circuits.

6. The method of claim 1 wherein said attaching includes attaching at least one rechargeable power source.

7. The method of claim 6 wherein said attaching includes coupling at least one solar panel to said at least one rechargeable power source.

8. The method of claim 1 wherein said providing includes providing a game table suitable for outdoor use.

9. The method of claim 1 wherein said mounting includes mounting one or more light emitting diodes.

10. The method of claim 1 further comprising attaching a controller configured to automatically switch said one or more lights on or off in response to predetermined conditions.

11. The method of claim 10 further comprising switching said lights on when the ambient light falls below a threshold.

12. The game table of claim 11 further comprising switching said lights off when the ambient light rises above a threshold.

13. The method of claim 11 further comprising switching said lights off a pre-set amount of time after said controller switches said lights on.

14. The method of claim 1, wherein said providing a game table includes providing a game table with a top, an upper apron and a lower apron, wherein said upper apron extends downward from said top and said lower apron is offset horizontally inward from said upper apron and extends vertically downward from said upper apron, and wherein said mounting one or more lights includes mounting one or more lights between said upper apron and said lower apron.

15. A method for providing lighting on a game table comprising:

providing a billiards table with a playing surface wherein said playing surface includes a surrounding rail;

mounting an upper apron with an outside portion to said rail, said upper apron defining an outside vertical side;

mounting a lower apron to said billiards table, with said lower apron having an outside vertical side offset horizontally inward and downward from said upper apron vertical side; and mounting one or more lights behind said upper apron vertical side in the horizontal distance between said lower apron and said upper apron outside portion, with said one or more lights facing downward towards the support surface.

16. The method of claim 15 further comprising mounting a power source to said table and coupling said power source to said lights.

17. The method of claim 16 further comprising recharging said power source.

18. The method of claim 17 further comprising:

mounting one or more solar panels to said billiards table; and recharging said power source with said one or more solar panels.

19. The method of claim 18 further comprising:

mounting a light sensor and a switch to said billiards table; and turning said lights on when the ambient light falls below a minimum level.

* * * * *

UNITED STATES PATENT AND TRADEMARK OFFICE

CERTIFICATE OF CORRECTION

PATENT NO. : 7,611,417 B2
APPLICATION NO. : 10/453358
DATED : November 3, 2009
INVENTOR(S) : Patrick Murrey It is certified that error appears in the above-identified patent and that said Letters Patent is hereby corrected as shown below:

In Claim 12, column 6, change "The game table of claim 11" to --The method of claim 11--

Signed and Sealed this

Fifth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,611,417 B2
APPLICATION NO. : 10/453358
DATED : November 3, 2009
INVENTOR(S) : Patrick Murrey It is certified that error appears in the above-identified patent and that said Letters Patent is hereby corrected as shown below:

In Claim 12, column 6, line 34, change "The game table of claim 11" to --The method of claim 11--

This certificate supersedes the Certificate of Correction issued January 5, 2010.

Signed and Sealed this

Twenty-sixth Day of January, 2010

David J. Kappos

David J. Kappos
*Director of the United States Patent and Trademark Office*